US008418351B2

(12) United States Patent
Gorlt

(10) Patent No.: US 8,418,351 B2
(45) Date of Patent: Apr. 16, 2013

(54) METHOD OF MANUFACTURING A COMMUTATOR

(75) Inventor: Wilfried Gorlt, Baden Württemberg (DE)

(73) Assignee: Johnson Electric S.A., Murten (CH)

( * ) Notice: Subject to any disclaimer, the term of this patent is extended or adjusted under 35 U.S.C. 154(b) by 335 days.

(21) Appl. No.: 12/816,547

(22) Filed: Jun. 16, 2010

(65) Prior Publication Data

US 2010/0314966 A1 Dec. 16, 2010

(30) Foreign Application Priority Data

Jun. 16, 2009 (CN) ..... 2009 1 0108089

(51) Int. Cl.
*H01R 43/06* (2006.01)
*H01R 43/10* (2006.01)

(52) U.S. Cl.
USPC ..... 29/597; 29/596; 310/237

(58) Field of Classification Search ..... 29/597, 29/598; 310/233–237
See application file for complete search history.

(56) References Cited

U.S. PATENT DOCUMENTS

| | | | | |
|---|---|---|---|---|
| 5,175,463 | A | | 12/1992 | Farago et al. |
| 5,245,240 | A | | 9/1993 | Takasaki |
| 5,255,426 | A | * | 10/1993 | Farago et al. ..... 29/597 |
| 5,530,311 | A | * | 6/1996 | Ziegler ..... 310/237 |
| 5,552,652 | A | | 9/1996 | Shimoyama et al. |
| 5,677,588 | A | | 10/1997 | Strobl |
| 5,793,140 | A | | 8/1998 | Tuckey |
| 5,826,324 | A | | 10/1998 | Abe et al. |
| 5,898,989 | A | | 5/1999 | Strobl |
| 5,910,259 | A | | 6/1999 | Warner |
| 5,912,253 | A | | 6/1999 | Cottens et al. |
| 5,925,961 | A | | 7/1999 | Sugiyanma |
| 5,925,962 | A | | 7/1999 | Kobman et al. |
| 5,932,949 | A | | 8/1999 | Ziegler et al. |
| 5,955,812 | A | | 9/1999 | Warner |
| 5,996,210 | A | | 12/1999 | König |
| 6,109,893 | A | | 8/2000 | Gliniecki et al. |
| 6,160,337 | A | | 12/2000 | Warner |
| 6,222,298 | B1 | | 4/2001 | Saito et al. |
| 6,236,136 | B1 | | 5/2001 | Hockaday et al. |
| 6,242,838 | B1 | | 6/2001 | Kiyose et al. |
| 6,259,183 | B1 | | 7/2001 | Hotta et al. |
| 6,359,362 | B1 | | 3/2002 | Schmidt |
| 6,584,673 | B2 | | 7/2003 | Schmidt |
| 6,617,743 | B1 | | 9/2003 | Potocnik et al. |

(Continued)

FOREIGN PATENT DOCUMENTS

WO WO 01/80405 10/2001

*Primary Examiner* — Minh Trinh
(74) *Attorney, Agent, or Firm* — Muncy, Geissler, Olds & Lowe, PLLC

(57) ABSTRACT

A method of manufacturing a commutator. A connector plate is formed with a plurality of connectors arranged circumferentially about a central opening and interconnected by links, with each connector having a terminal portion, a segment portion and a number of anchors, with adjacent segment portions being separated circumferentially by slits. A conductive layer is fixed onto a first face of the segment portions to form a brush contacting surface. The connectors are separated by severing the links. The base is fixed to a second face of the connectors. Then the conductive layer is separated into circumferentially arranged segment parts by cutting radial slots through the conductive layer aligned with the slits, the width of the slots being narrower that the width of the slits to avoid cutting the connectors.

9 Claims, 4 Drawing Sheets

U.S. PATENT DOCUMENTS

| | | | | |
|---|---|---|---|---|
| 6,634,082 | B1 | 10/2003 | Ziegler et al. | |
| 6,657,355 | B2 | 12/2003 | Kiyose et al. | |
| 6,667,565 | B2 | 12/2003 | Strobl | |
| 6,684,485 | B1 | 2/2004 | Potocnik et al. | |
| 6,710,500 | B1 | 3/2004 | Wagner et al. | |
| 6,784,589 | B1 | 8/2004 | Sugiyama | |
| 6,789,306 | B1 | 9/2004 | Konig | |
| 6,833,650 | B2 | 12/2004 | Hara et al. | |
| 7,019,432 | B1 | 3/2006 | Potocnik | |
| 7,043,822 | B2 * | 5/2006 | Kobayashi et al. | 29/597 |
| 7,051,422 | B2 | 5/2006 | Sugiyama | |
| 7,462,972 | B2 * | 12/2008 | Kumar et al. | 310/233 |
| 7,716,810 | B2 * | 5/2010 | Aoyama et al. | 29/597 |
| 2007/0294877 | A1 | 12/2007 | Potocnik et al. | |

* cited by examiner

METHOD OF MANUFACTURING A COMMUTATOR

CROSS REFERENCE TO RELATED APPLICATIONS

This non-provisional patent application claims priority under 35 U.S.C. §119(a) from Patent Application No. 200910108089.2, filed in The People's Republic of China on Jun. 16, 2009.

FIELD OF THE INVENTION

The present invention relates to a flat or planar commutator and to a process for manufacturing the commutator. It is especially suited to graphite commutators.

BACKGROUND OF THE INVENTION

Graphite segment commutators are known in the art. A typical flat graphite commutator comprises a phenolic base, a copper connector attached on one side to the base, and a graphite disk soldered on to the other side of the copper connector. The commutator is slotted by cutters to form a plurality of segments after the connector, disk and base have been secured together. The slots extend diagonally across the graphite disk and axially through the disk and connector to separate the disk and connectors into a plurality of segments. To ensure complete separation of the copper connectors into the segments the slots extend axially into the base. Thus the slots are deep. Furthermore, the cut edges of the connectors, i.e., the lateral faces of the connector portions of the segments bordering the slots, are exposed. Moreover, in the process of slotting large stress is generated between the connector and the base because of shrinkage of the base, which will lead to sticking of the cutters in the copper connectors and overheating of the cutters and copper connectors due to friction. Overheating of the copper connectors is dangerous for the solder connection between the copper connector and the graphite disc leading to dry joints between the disk and the connector, and it may lead to heat degradation and increased resistance of the graphite disc portion of the affected segments.

As such, it is desirable to provide an improved process for manufacturing a flat graphite commutator which can overcome the above-mentioned problem.

SUMMARY OF THE INVENTION

Accordingly, the present invention provides a method of manufacturing a commutator which comprises an electrically non-conductive base supporting a plurality of commutator segments forming a planer brush contact surface, each segment having a connector and a segment part fixed to the connector, the method comprising the steps of: forming a connector plate having a plurality of connectors arranged circumferentially about a central opening and interconnected by links, each connector having a terminal portion, a segment portion and a number of anchors, adjacent segment portions being separated circumferentially by slits, the segment portions having a first face and a second face opposite the first face, fixing a conductive layer on the first face of the segment portions to form a brush contacting surface, severing the links to separate the connectors, fixing the base to the second face of the connectors, separating the conductive layer into circumferentially arranged segment parts by cutting radial slots through the conductive layer aligned with the slits, the width of the slots being narrower that the width of the slits to avoid cutting the connectors.

Preferably, the method further comprises the step of providing the conductive layer in the form of an annular disc.

Preferably, the step of fixing a conductive layer on the first face of the segment portions to form a brush contacting surface includes providing the conductive layer in the form of an annular disc of a conductive material containing graphite and soldering the annular disc to the segment portions of the connectors.

Preferably, the step of fixing the base to the second face of the connectors further comprises molding the base directly to the connectors before the conductive layer is cut into segment parts, embedding the anchors in the base and filling gaps formed by the slits between the connectors with material of the base.

Preferably, the method further comprises the step of cutting the slots through the conductive layer to an axial depth sufficient to cut the material of the base within the slits without the slots extending beyond the second face of the connectors.

Preferably, the method further comprises the steps of forming the links at the outermost ends of the slits in a radial direction of the connector plate, and severing the links after the conductive layer is fixed to the connector plate.

Preferably, the method further comprises the step of forming the base by molding after the step of severing the links.

Preferably, the method further comprises the step of forming inner and outer anchors on the connectors and forming the links between the outer anchors of adjacent connectors at the outermost ends of the slits in a radial direction of the connector plate.

Preferably, the method further comprises the step of forming the links at the distal ends of the anchors with each link connecting the distal ends of two anchors of adjacent connectors.

According to a second aspect, the present invention also provides a commutator comprising: an electrically non-conductive base, a plurality of commutator segments fixed to the base, each segment comprising an electrically conductive connector and a segment part of an annular disc adapted to make sliding contact with brushes, the connector has a segment portion, a terminal portion and anchors all formed as a monolithic construction, the terminal and anchors extending from the segment portion at radial ends thereof, the anchors being embedded in the base; the segment part is a part of an annular disc forming an electrically conductive brush-contacting layer fixed to a side of the segment portion remote from the base, and wherein the segment portions are circumferentially separated by slits into which the base extends and the segment parts are separated circumferentially by slots, the slots are aligned with the slits, are narrower than the slits and extend axially into the base within the slits between the connectors.

Preferably, the slots extend into the body in the corresponding slits without contacting the connector.

Preferably, the annular disc is of material containing graphite.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
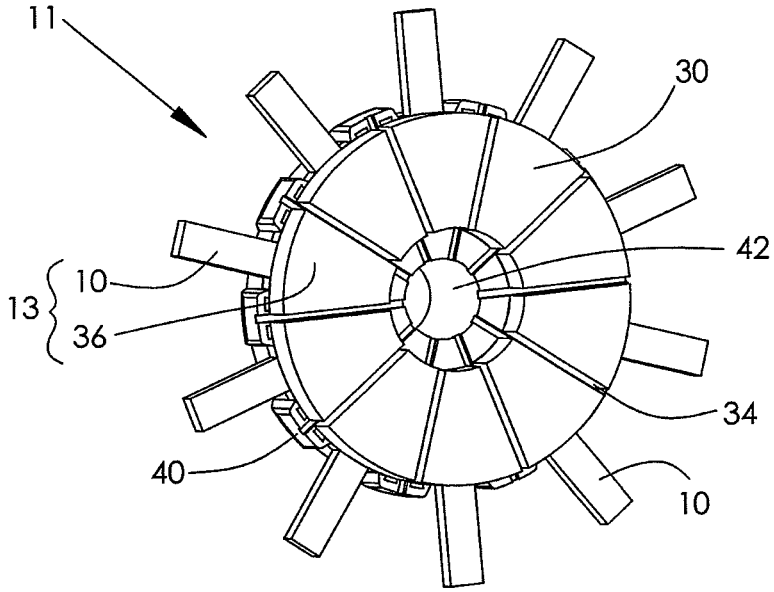
FIG. 1 is a view from above of a commutator according to a preferred embodiment of the present invention.

FIG. 1 is a view from above of a commutator 11 being the preferred embodiment of the present invention. FIGS. 2 to 6 show different stages in the construction of the commutator. The commutator comprises an electrically insulating base 40 supporting a plurality of commutator segments 13. Each segment 13 comprises a connector 10 and a segment part 36 which makes sliding contact with the brushes of the motor. The segment part is fixed to one side of the connector and the opposite side of the connector is fixed to the base 40, thus the segments are supported by and fixed relative to each other by the base.

Figure 2:
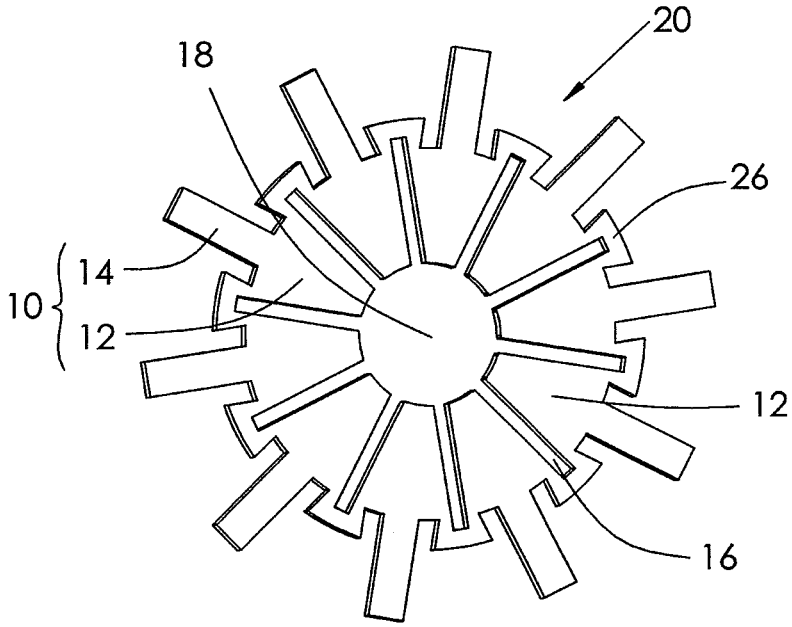
FIG. 2 is a view from above of a terminal plate, being a part of the commutator of FIG. 1.
Figure 3:
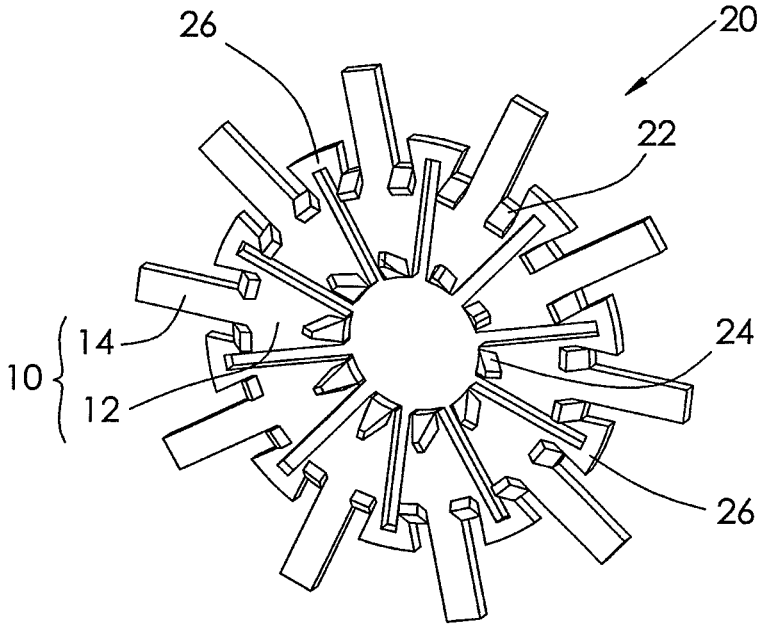
FIG. 3 is a view from below of the terminal plate of FIG. 2.

FIG. 2 shows a connector plate 10 from which the connectors are formed. The connector plate is stamped from a sheet of metal, preferably copper, to form a number of connectors arranged as desired for direct placement on the base and interconnected by links 26 between adjacent connectors. Each connector has a flat segment portion arranged extending radially from a central opening 18 and separated from adjacent segment portions by slits 16. Each connector has a terminal portion 14 extending radially from a segment portion 12, preferably one terminal per segment portion. Each terminal portion provides a connection to lead wires for the windings of the rotor to which the commutator is fitted, in use. The terminals may be the common U-shaped tangs used for welding, fusing or otherwise of the lead wire or of some other suitable form such as an insulation displacing terminal. As such the terminal portion is depicted as a straight bar for ease of drawing. FIG. 3 illustrates the rear surface of the connector plate, showing inner anchors 24 and outer anchors 22 in the form of fingers extending from the inner and outer radial edges of the segment portion and bent to extend axially downward from the segment portion. The anchors get embedded into the base to hold the connector to the base, as will be described below. Thus, as can be seen, the connectors are formed by taking a sheet of metal and stamping or cutting the sheet to form the connectors joined together by links and having an upper flat surface on the segment portions and anchors extending below for connecting to the base. Each of the segment portions being separated by slits formed in the plate. The links 26 preferably join together adjacent connectors by extending radially from the radially outer edge of the segment portions 12 and adjacent to the outer anchors 22. Thus the radially outer edge of each segment portion has a central terminal portion 14 located between two outer anchors 22 which in turn are located between two links 26, in the preferred embodiment.

Figure 4:
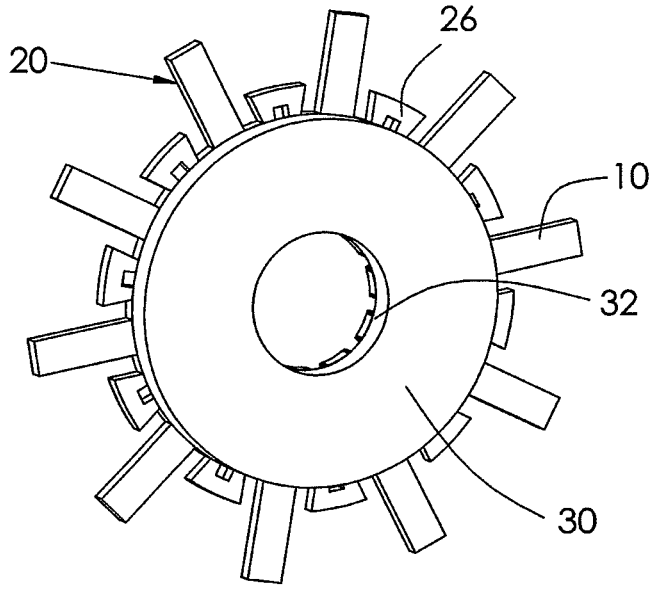
FIG. 4 is a view from above of the terminal plate of FIG. 1 combined with a graphite disk, being a further part of the commutator of FIG. 1.
Figure 5:
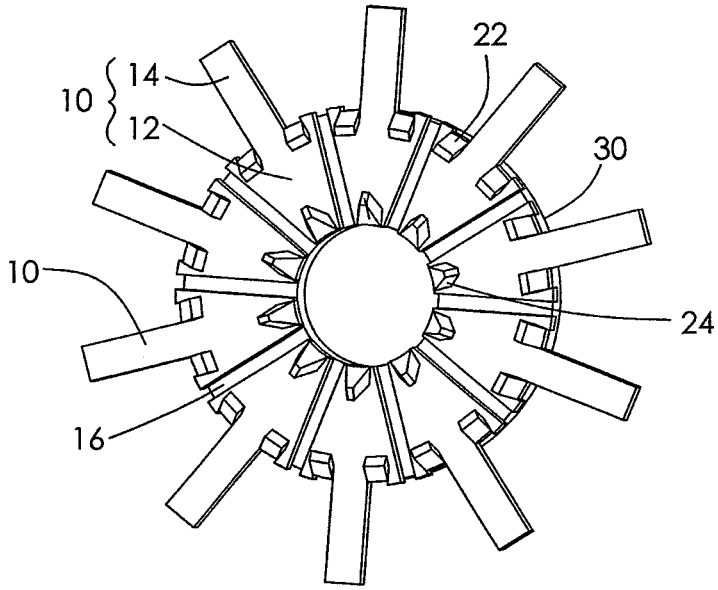
FIG. 5 is a view from below of the combination of FIG. 4.
Figure 6:
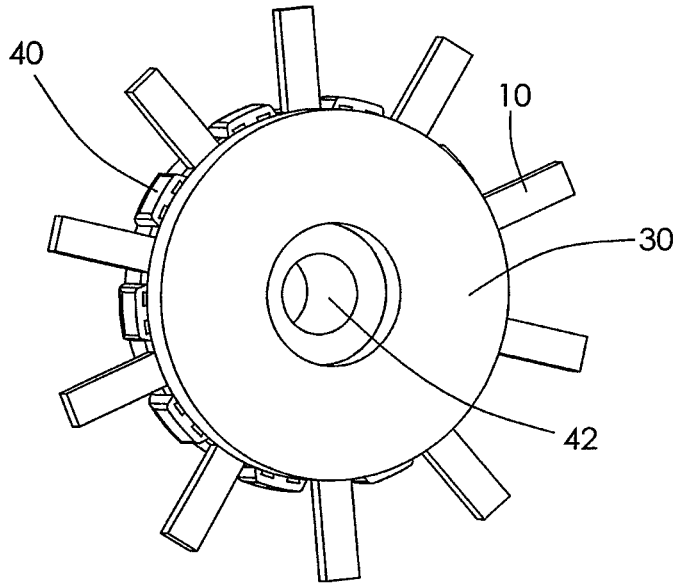
FIG. 6 is a view from above of the terminal plate and disk of FIG. 4 further combined with a body.

FIGS. 4 & 5 show an annular conductive disc 30 fixed to the upper surface of the connector plate corresponding to the segment portions. The disc has a central opening 32 which is coaxial with the central opening 18 of the connector plate. The disc forms an electrically conductive brush-contacting layer. The disc 30 is preferably formed from a material containing graphite and is fixed to the connector plate by a solder process. This process may involve pre-treating the interface between the disc and the connector plate, such as pre-coating the upper surface of the segment portions with solder or a solderable material. Once the disc has been fixed to the connector plate, the links between the connectors can be removed as shown in FIG. 5. The links are preferably removed by severing the links close to where they join the connector, at the radially outer edge of the segment portion.

The base 40 and the connectors 10 are fixed together by molding the base directly to the connectors 10 with the anchors 22,24 being directly embedded within the base to fix the connectors to the base. The base also has a central opening 42 which is coaxial with the opening 18 in the connector plate and the opening 32 in the disc 30.

Once the connectors fixed to the disc have been fixed to the base the disc 30 is slotted to divide the disc into a plurality of segment parts corresponding to the segment portions 12 of the connectors 10. Thus slots 34, dividing the disc 30 create separate commutator segments 13 individually fixed to the base and thus complete the forming of the commutator. The slots 34 dividing the segments cut through the disc and into the base 40 to ensure that the disc is fully separated into the segments. However, the slots 34 are aligned with the slits 16 and thus the slots only need to extend axially into the material of the base which extends into the slits 16 and not deeper into the base. The slits 16 are wider than the slots 34 such that material of the base covers and protects the lateral edges of the segment portions and the cutters forming the slots 34 do not cut into the connectors, thus avoiding exposing the material of the connectors within the slots.

Figure 7:
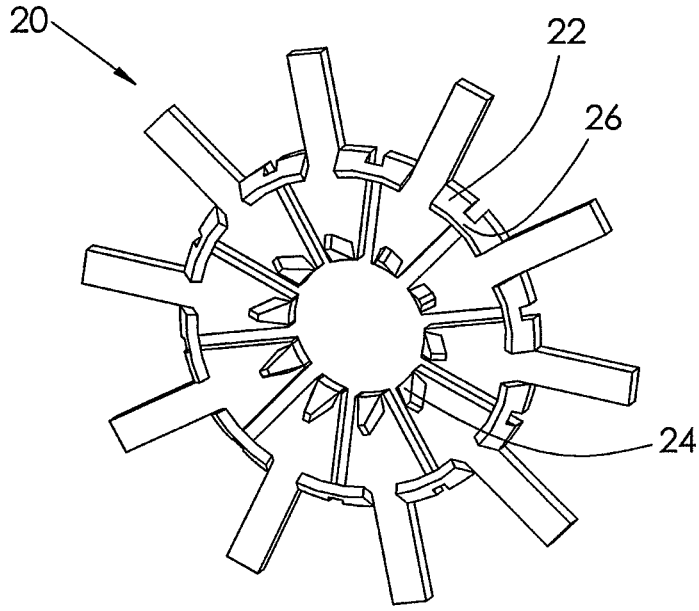
FIG. 7 is view similar to FIG. 3, of a modified terminal plate.

FIG. 7 illustrates an alternative construction of the links 26 between the segment portions 12. In this embodiment the links are formed extending between the distal ends of the outer anchors 22. This allows the links to be stronger but the severing of the links is a little more complicated in production.

Figure 8:
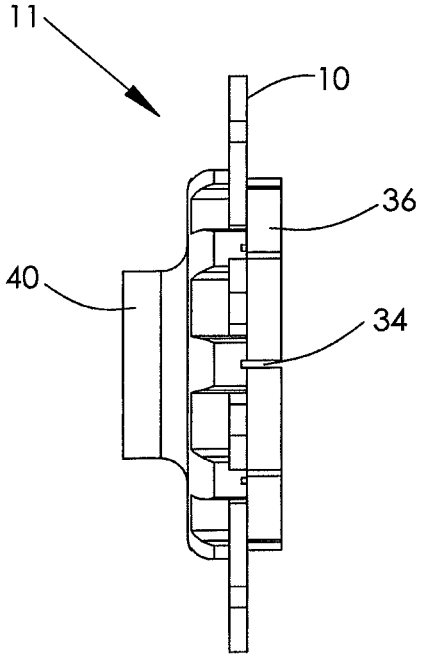
FIG. 8 is a side view of the commutator of FIG. 7.
Figure 9:
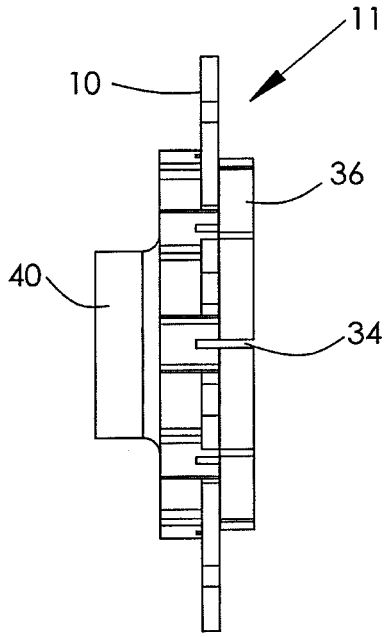
FIG. 9 (Prior Art)
FIG. 9 is a side view similar to FIG. 8 of a prior art commutator.

FIG. 8 is a side view of the complete commutator shown in FIG. 1. It can be clearly seen that the slots 34, which separate the disc 30 into individual segment parts 36, extend in the axial direction of the commutator through the disc and into the material of the base to ensure complete separation of the segment parts. However, as is preferred the slots 34 of FIG. 8 do not extend axially beyond the second face of the connectors. The slots extend axially just enough to ensure separation of the segment parts. This gives stronger support for the commutator segments compared to the prior art commutator of FIG. 9 in which the slots extend axially beyond the second face of the connectors as the slots 34 must also separate the connectors. This also leaves the edges of the connectors vulnerable to chemical attack if used in a hostile environment.

As can be understood from the description above, the method of manufacturing a commutator comprises the following steps. Firstly, forming a connector plate 20 having a plurality of connectors 10 arranged circumferentially about a central opening 18 and interconnected by links 26. Each connector has a segment portion 12, a terminal portion 14 and a number of anchors 22, 24. Adjacent segment portions 12 are separated circumferentially by slits 16. The segment portions 12 have a first face and a second face opposite the first face. The links 26 hold the connectors in the correct relative orientation and allow the connectors to be handled as a single item reducing the complexity of trying to maintain in place a number of smaller items.

A conductive layer 30, preferable in the form of an annular ring, is fixed to the first face of the segment portions to form a brush contacting surface. The conductive layer is optionally formed of a material containing graphite and is soldered to the connectors.

Once the ring is fixed to the connectors the links 26 may be severed or cut to divide the connector plate into individual connectors which are still held in fixed orientation by the conductive layer. The base 40 is now molded directly to the connector/ring combination, with the material of the base filling the gaps formed between the connectors by the slits 16. The conductive layer 30 is now divided into separate circumferentially arranged segment parts by cutting radial slots through the disc. The slots 34 are aligned with the slits 16 and extend into the material of the base within the slits. The connectors are not cut during this cutting step as the width of the slots 34 is narrower than the width of the slits 16.

The material of the connectors may be any suitable conductive material, especially metal and most preferably copper. The material of the base is any suitable electrically non-conductive material, preferably a moldable resin and most preferably, phenolic.

While the preferred method is to fix the conductive layer to the connector plate before fixing the connector plate to the base, it is possible to fix the connector plate to the base before fixing the conductive layer to the connectors. Either way the links are not severed until the connector plate has been fixed to one or both of the base and the conductive layer so as to hold the connectors in the correct orientation during manufacture.

The conductive brush-contacting layer 30 preferably is secured to the connector s 10 by soldering. Preferably, the layer 30 is made of graphite and rigidly secured to the side of the terminal 10 by a solder connection. Preferably, a solder layer is added to the side of the connector 10 before the soldering step, to improve solderability of the connector 10 and to protect the copper against oxidation. The conductive brush-contacting layer 30 may also require or benefit from pre-soldering treatment to increase the solderability and reliability of the solder connection.

In the preferred embodiment, the layer 30 is soldered to the connector 10 before the base 40 is molded to the connector 10. Thus, the solder process can use a higher temperature to have better solder flow. Furthermore, less stress will be generated between the connector 10 and base 40 when cutting the slots 34 in the layer 30 due to the slits 16 being preformed in the connector 10 without needing to cut the connector 10 and the layer 30 at the same time, whereby avoiding sticking and/or overheating of the cutter and avoiding heat damage to the layer 30 and the solder layer preformed on the connector 10.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A method of manufacturing a commutator which comprises an electrically non-conductive base supporting a plurality of commutator segments forming a planer brush contact surface, each segment having a connector and a segment part fixed to the connector, the method comprising the steps of:

forming a connector plate having a plurality of connectors arranged circumferentially about a central opening and interconnected by links, each connector having a terminal portion, a segment portion and a number of anchors, adjacent segment portions being separated circumferentially by slits, the segment portions having a first face and a second face opposite the first face, fixing a conductive layer on the first face of the segment portions to form a brush contacting surface, severing the links to separate the connectors, fixing the base to the second face of the connectors, separating the conductive layer into circumferentially arranged segment parts by cutting radial slots through the conductive layer aligned with the slits, the width of the slots being narrower that the width of the slits to avoid cutting the connectors.

2. The method of claim 1, further comprising the step of providing the conductive layer in the form of an annular disc.

3. The method of claim 2, further comprising the step of forming the base by molding after the step of severing the links.

4. The method of claim 1, wherein the step of fixing the base to the second face of the connectors further comprises molding the base directly to the connectors before the conductive layer is cut into segment parts, embedding the anchors in the base and filling gaps formed by the slits between the connectors with material of the base.

5. The method of claim 4, further comprising the step of cutting the slots through the conductive layer to an axial depth sufficient to cut the material of the base within the slits without the slots extending beyond the second face of the connectors.

6. The method of claim 1, further comprising the steps of forming the links at the outermost ends of the slits in a radial direction of the connector plate, and severing the links after the conductive layer is fixed to the connector plate.

7. The method of claim 1, further comprising the step of forming the links at the distal ends of the anchors with each link connecting the distal ends of two anchors of adjacent connectors.

8. The method of claim 1, further comprising the step of forming inner and outer anchors on the connectors and forming the links between the outer anchors of adjacent connectors at the outermost ends of the slits in a radial direction of the connector plate.

9. The method of claim 1, wherein the step of fixing a conductive layer on the first face of the segment portions to form a brush contacting surface, includes providing the conductive layer in the form of an annular disc of a conductive material containing graphite and soldering the annular disc to the segment portions of the connectors.

* * * * *